United States Patent [19]

Landwehrkamp et al.

[11] Patent Number: 4,916,891

[45] Date of Patent: Apr. 17, 1990

[54] OPEN-END ROTOR SPINNING MACHINE

[76] Inventors: Hans Landwehrkamp, Lilientrasse 4; Eugen Hini, Berggasse 1, both of 8071 Lenting; Eberhard Grimm, Roemerstrasse 37, 8070 Ingolstadt, all of Fed. Rep. of Germany

[21] Appl. No.: 257,720

[22] Filed: Oct. 12, 1988

[30] Foreign Application Priority Data

Oct. 13, 1987 [DE] Fed. Rep. of Germany ..... 3734545

[51] Int. Cl.[4] ..... D01H 7/882; D01H 11/00; D01H 1/20

[52] U.S. Cl. ..... 57/406; 57/78; 57/92; 57/104

[58] Field of Search ..... 57/400, 401, 404, 406, 57/92, 103, 104, 78

[56] References Cited

U.S. PATENT DOCUMENTS

| | | | |
|---|---|---|---|
| 3,805,506 | 4/1974 | Stahlecker | 57/406 X |
| 3,868,815 | 3/1975 | Stahlecker | 57/406 X |
| 3,877,212 | 4/1975 | Canzler | 57/406 X |
| 4,653,265 | 3/1987 | Stahlecker et al. | 57/406 |
| 4,667,464 | 5/1987 | Stahlecker et al. . | |
| 4,676,673 | 6/1987 | Stahlecker et al. . | |
| 4,713,932 | 12/1987 | Zott | 57/406 |

FOREIGN PATENT DOCUMENTS

| | | |
|---|---|---|
| 3533717 | 3/1987 | Fed. Rep. of Germany . |
| 3622523 | 1/1988 | Fed. Rep. of Germany . |

*Primary Examiner*—Donald Watkins
*Attorney, Agent, or Firm*—Dority & Manning

[57] ABSTRACT

An open-end rotor spinning machine which operates at rotor speeds higher than 100,000 rpm is constructed so that the critical system rotational speed is higher than the 100,000 rpm operating rotational speed. The rotatable rotor has a shaft bearingly supported in the nip between at least two pairs of supporting disks. Each disk has a plastic outer covering around the circumferential surface thereof and preferably is provided with at least one recess along its circumference. An elastic support surface preferably covers the circumference of each disk and is disposed between the disk and its outer plastic covering. The interior distance between the disks is from 20 to 69 mm. A circumferential recess preferably is disposed in at least on of the lateral surfaces of the plastic covering of each supporting disk. An electric motor drives a drive pulley, and the two are mounted in a stationary mounting while a swivellable pillow block moves the shaft to press against the drive pulley for driving the shaft and rotating the rotor. The center of gravity of the spinning rotor is at a distance of from 15 to 28 mm in front of the closest of the two pairs of supporting disks to the rotor. The free end of the rotor bears against an axial bearing and extends from 5 to 30 mm beyond the pair of supporting disks farthest away from the rotor and in the direction of the axial bearing.

27 Claims, 4 Drawing Sheets

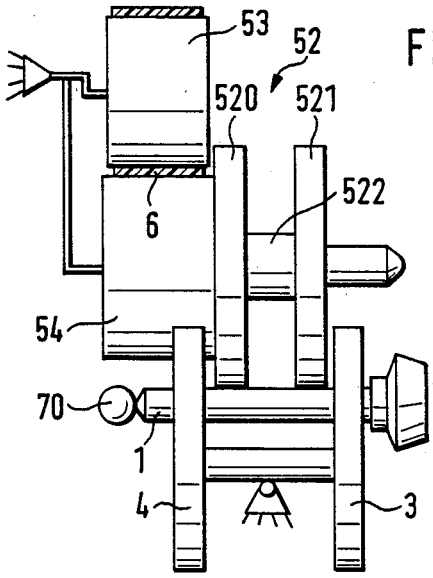
FIG. 4
FIG. 5
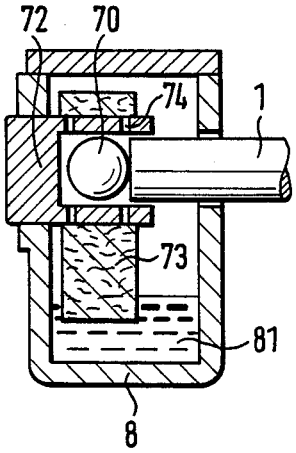
FIG. 6
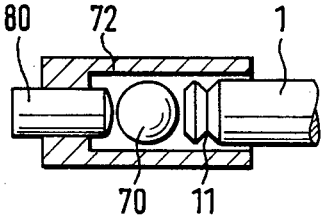
FIG. 7
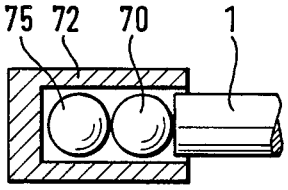

OPEN-END ROTOR SPINNING MACHINE

The instant invention relates to an open-end rotor spinning machine with a spinning rotor, the shaft of which is bearingly supported in the nip of pairs of supporting disks which are provided with a plastic covering and which bears with its free end upon an axial bearing, as well as with driving means.

To support the shaft of a spinning rotor radially in a nip constituted by pairs of supporting disks and to provide its free end with an axial bearing upon which the shaft bears is a known design (German publicly distributed printed copy of the application papers 1,901,453). The shaft is driven by means of a belt applied directly to the shaft or indirectly, via the supporting disks or via a driving pulley, whereby the belts or the driving pulleys are pressed against the shaft between the pairs of supporting disks.

In an effort to achieve higher rotational speeds, the proposal has been made to size this known bearing support with direct drive of the rotor shaft via a tangential belt so that without increased use of materials and disproportionately increased energy consumption, rotor speeds of at least 000 rpm and more can be achieved (German publicly distributed printed copy of the application papers 3,324,129).

It is the object of the instant invention to create an open-end rotor spinning machine of the type mentioned initially and capable of even higher rotational speeds and which is at the same time subcritical (below the first critical speed of rotation).

This object is attained through the invention in that the pairs of supporting disks are at an inside distance of 20 to 69 mm from each other, in that the center of gravity of the rotor at a distance of 15 to 28 mm in front of the first pair of supporting disks and in that the shaft of the spinning rotor has a diameter of 5 to 9 mm and in that its free end extends 5 to 30 mm beyond the last pair of supporting disks towards the axial bearing.

This makes it possible to achieve rotor speeds of 150,000 rpm and more.

Further embodiments of the invention, the advantages of which are to be found in the description, are contained in the sub-claims.

Embodiments of the invention are described through the drawings in which

Figure 3:
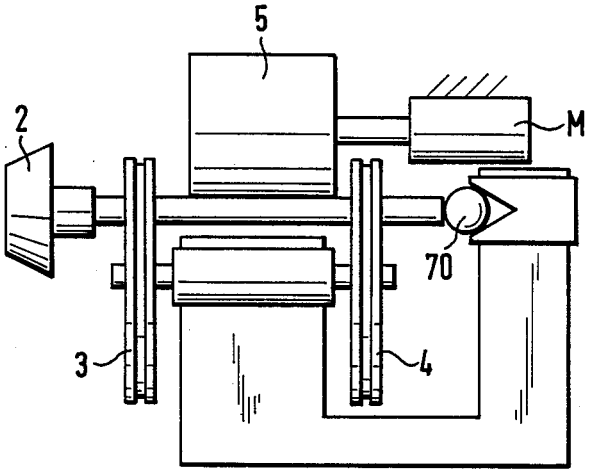
FIG. 3 shows a lateral view of an indirect drive of the rotor shaft via a driving pulley driven by an electric motor.
Figure 3A:
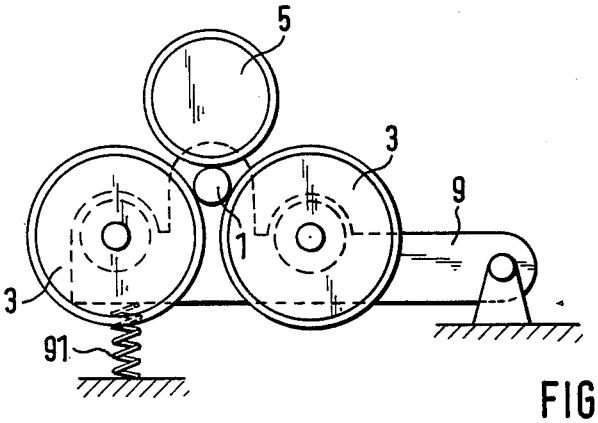

FIG. 3*a* shows a front view of a device similar to that of FIG. 3, with a shaft bearing that can be assigned to the driving pulley;

FIG. 4 shows a lateral view of an indirect drive of the rotor shaft via a tandem pulley; and FIGS. 5 to 9 show sectional views of various embodiments of an axial ball bearing for the rotor shaft.

Figure 1:
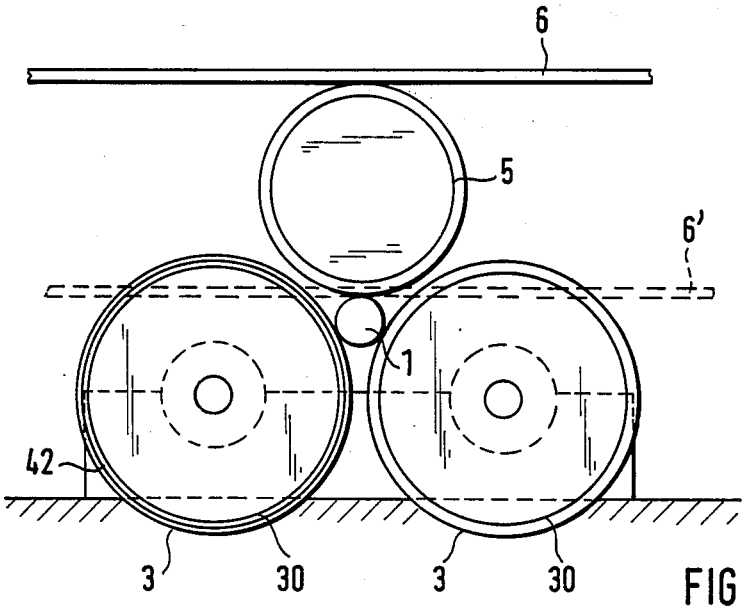
FIG. 1 shows a frontal view of a rotor shaft bearingly supported in the nip of supporting disks.
Figure 2:
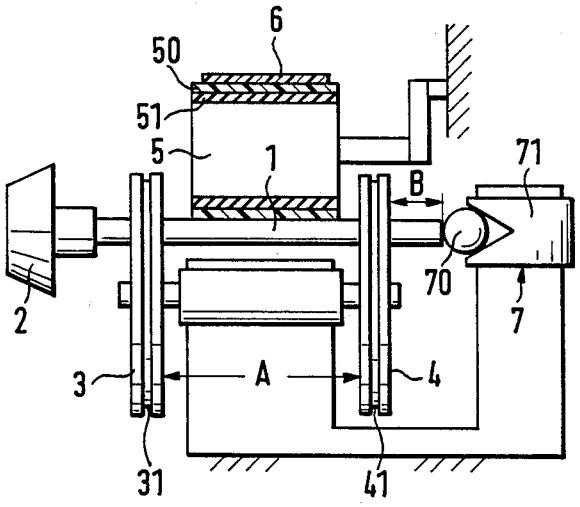
FIG. 2 shows a lateral view of a device according to FIG. 1

As can be seen in FIGS. 1 and 2, the shaft 1 of a spinning rotor 2 is bearingly supported in a nip which is constituted by two pairs of supporting disks 3 and 4 provided with an elastic, plastic running surface covering 30. The supporting disks have a diameter from 70 to 80 mm. Shaft 1 is driven indirectly via a driving pulley be upon it, over which a tangential belt 6 runs. However, the tangential belt can also drive shaft 1 directly if necessary. This alternative is indicated by reference 6', in FIG. 1. An axial bearing 7 with a ball 70 capable of being rotated in a holding device 71 is assigned to the free end 10 of shaft 1. The shaft 1 is pressed by an axial force in a known manner with its free end against the ball. Different kinds of supports of the shaft in axial direction, for instance by means of a plate, are also possible.

The pairs of supporting disks 3 and 4 are installed at a distance A from each other which, measured from inside to inside, comes to 20 to 69 mm. A rotor shaft with a diameter of 5 to 9 mm the free end of which extends for a length B of 5 to 30 mm the pair of supporting disks 4 in direction of the axial bearing 7 is used as a support of the spinning rotor 2. Furthermore, provisions are made for the center of gravity of the spinning rotor 2 to be located at a distance of 15 to 28 mm in front of the first pair of supporting disks 3.

The driving pulley 5 which drives the shaft 1 is provided with a covering 50 which has a greater coefficient of friction in order to increase the drive contact with shaft 1. The material for the covering 50 should ideally be of the type used for the running surface of a tangential belt. In addition, an elastic supporting layer 51 can be applied on the base body of the driving pulley 5, with the running covering 50 applied only on top of it. This makes it possible to obtain stronger grip on shaft 1 by the driving pulley.

The thickness of the running surface 30 of the pairs of supporting disks 3 and 4 can measure from 2 to 6 mm. In order to ensure sufficient life of the running surface 30 of the pairs of supporting disks 3 and 4 at the high rotational speeds which can be attained by the spinning rotor, said running surface 30 is broken by at least one recess in form of an endless groove 31 or 41. The depth of the grooves 31, 41 is sized so that the surface covering 30 maintains a remaining depth of at least 1 mm. The grooves cause cooling of the covering and thereby decrease wear resulting from excessive heating. In order to achieve even better cooling of the running surface 30, at least one of the lateral surfaces can be provided with a recess 42 in the sense of the circumference if necessary. Such a groove (or grooves) for heat removal can also be worked into the covering 50 of the driving pulley 5. Another possibility of maintaining heating of the covering 50 of the driving pulley 5 within limits consists in dividing the covering 50 in the direction of the circumference and in keeping the parts at a distance from each other.

It is however possible to dispense with grooves in the running surface coverings for heat removal if a running surface covering of little thickness is applied to an aluminum disk or to some other, highly heat-conductive base body. For this reason a covering surface of 2 to 2.5 mm, and of no more than 3 mm, is preferably provided for the pairs of supporting disks 3 and 4, promoting heat removal while maintaining sufficient elasticity.

FIG. 3 shows a device with an indirect drive of the shaft 1 which is bearingly supported in the nip of the pairs of supporting disks 3 and 4 via a driving pulley 5 as in FIG. 2, but with the difference that the driving pulley 5 is located on the drive shaft of an electric motor M. The driving pulley 5 and the electric motor M are installed on a spring-loaded yoke in a manner not shown in detail, in order to ensure a defined pressure force of the shaft into the nip.

In FIG. 3*a* the driving pulley 5 and the electric motor which drives it are stationary, and the pillow block 9 supporting the shaft bearing is mounted so as to be capable of swivelling. The swivelling motion is around an axis which is essentially parallel to the axes bearing the pairs of supporting disks 3 and 4. Shaft 1 of the spinning rotor is brought to bear against the driving pulley 5 by swivelling the pillow block 9 and is pressed against the driving pulley 5 by means of a spring 91 acting upon the pillow block.

In the embodiment according to FIG. 4, the shaft 1 bearingly supported in the nip of the pairs of supporting disks 3 and 4 is driven indirectly via a driving pulley in form of a tandem pulley 52 with the characteristic that two narrow individual pulleys 520 and 521 are mounted fixedly and at a distance from each other on a common axle 522. The distance between the individual pulleys 520 and 521 is less than that between the pairs of supporting disks 3 and 4, so that the tandem roller 52 can be located between said pairs of supporting disks 3 and 4. The two individual rollers 520 and 521 have a driving contact with shaft 1 near the pairs of supporting disks 3 and 4 and at equal distance to them. The tandem pulley 52 is driven by the tangential belt 6 which is pressed by a tension pulley 53 with a predetermined contact pressure against a rim 54 of the tandem pulley 52 and returns to the tension pulley 53. When the shaft 1 is driven by the tandem pulley 52 which presses said shaft 1 into the nip of the pairs of supporting disks, the spinning rotor's breakdown torque decreases. The running attitude is improved and the contact pressure used to run the spinning rotor 2 or the shaft 1 can be reduced, so that even with a smaller diameter of shaft 1, no excessive bending of the shaft takes place. Thus for example, a high transmission ratio is achieved with a shaft diameter of 6.5 mm, diameters of 80 mm for the pairs of supporting disks 3 and 4 and the tandem pulley 52 and of 60 mm for the rim.

In order to secure the shaft axially and to lubricate it at the attainable speeds of over 150,000 rpm, the ball 70 of the axial bearing is inserted with little clearance in a cylindrical steel sleeve 72 which is screwed into a bearing housing 8 (FIG. 5). The bearing housing 8 is closed by a cover. A lubricating felt 73, dipping into an oil bath 81 in the lubricant container 8 is pushed over the sleeve 72. The oil transferred by the lubricating felt 73 to the sleeve 72 can reach the ball 70 and the free end 10 of the shaft 1 through radial perforations 74 which are made in the sleeve 72, outside the running surface of the ball. Instead of a steel sleeve, a sleeve made of a sintered material can be used, through the pores of which the oil reaches the inside of sleeve 72. The perforations 82 can be omitted in that case. The contact between the free end of the shaft 1 and the ball 70 occurs inside sleeve 72, so that the oil thrown off from the sleeve 72 is caught and remains in circulation. The throwing off of the lubricant into sleeve 72 can be further assisted by a wedge-shaped groove 11 near the free shaft end, as shown in FIG. 6. Also, in this embodiment the ball 70 does not bear upon a flat surface as in FIG. 5, but upon a steel pin 83 which has a rounded end on its side towards the ball 70.

In FIG. 7 the ball 70 is followed in axial direction by a second ball 75, so that the first ball 70 bears upon the ball 75 and is able to rotate freely. The ball 75 is also able to rotate.

Figure 8:
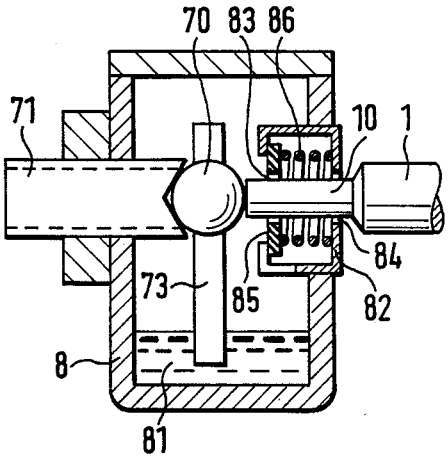
Figure 9:
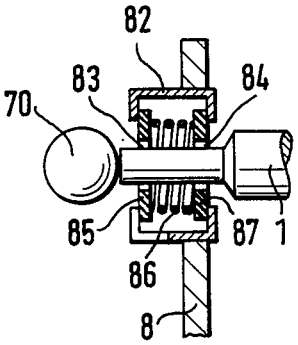

FIG. 8 shows a holding device 71, as in FIG. 2, screwed into the bearing housing 8 to hold the ball 70. The side of the bearing housing 8 across from the holding device 71 has an opening into which a cylindrical housing 82 with the passage openings 83 and 84 for the shaft 1 is inserted. Near its free end 10, the diameter of shaft 1 is reduced. The sealing washer 85 is floatingly held against the passage opening 83 and is pressed with slight pressure against the contact surfaces delimiting the passage opening 83 by means of a spring 86 in order to avoid constant pressure of the sealing washer 85 against the free shaft end 10. Oil dripping from the sealing washer 85 returns through an opening in housing 82 into the lubricant bath 81.

In addition to the sealing washer 85 which closes the passage opening 83 in housing 82, a second sealing washer 87 can be provided in the housing 82 to seal the passage opening 84 against which it is also floatingly held.

We claim:

1. Open-end rotor spinning machine comprising:

a rotatable rotor having a shaft;

at least two pairs of supporting disks, each disk being provided with a plastic covering around the circumferential surface thereof, said surfaces of each said pair of disks forming a nip therebetween which bearingly supports said rotor shaft;

an axial bearing receiving the free end of said shaft, means for driving said shaft, wherein the pairs of supporting disks are at an interior distance of 20 to 69 mm from each other, the center of gravity of the spinning rotor is at a distance of 15 to 28 mm in front of the pair of supporting disks disposed closer to said rotor, the shaft of the spinning rotor has a diameter of 5 to 9 mm and its free end extends 5 to 30 mm beyond the pair of supporting disks disposed farther from said rotor in the direction of the axial bearing.

2. Open-end rotor spinning machine as in claim 1, characterized in that the pairs of supporting disks have diameters of 70 to 80 mm.

3. Open-end rotor spinning machine as in claim 1, characterized in that said driving means includes a driving pulley for driving the shaft of the spinning rotor.

4. Open-end rotor spinning machine as in claim 3, further comprising:

a belt for driving the driving pulley.

5. Open-end rotor spinning machine as in claim 3, further comprising:

an electric motor, said driving pulley being driven by said electric motor.

6. Open-end rotor spinning machine comprising:

a rotatable rotor having a shaft;

at least two pairs of supporting disks, each disk being provided with a plastic covering around the circumferential surface thereof, said surfaces of each said pair of disks forming a nip therebetween which bearingly supports said rotor shaft;

an axial bearing receiving the free end of said shaft;

means for rotatably driving said shaft, said driving means being carried by a stationary mounting, means for moving said shaft into driving engagement with said driving means; and wherein the pairs of supporting disks are at an interior distance of 20 to 69 mm from each other, the center of gravity of the spinning rotor is at a distance of 15 to 28 mm in front of the pair of supporting disks disposed closer to said rotor, the shaft of the spinning rotor has a diameter of 5 to 9 mm and its free end extends 5 to 30 mm beyond the pair of supporting disks disposed farther from said rotor in the direction of the axial bearing.

7. Open-end rotor spinning machine as in claim 6, wherein:

said driving means includes a motor and a driving pulley driven by said motor, and said shaft moving means includes a movable pillow block for moving said shaft to press said shaft against said driving pulley.

8. Open-end rotor spinning machine as in claim 3, characterized in that the driving pulley is provided with a covering with a high coefficient of friction.

9. Open-end rotor spinning machine as in claim 8, characterized in that the covering is made of the same material as the running surface of a tangential belt.

10. Open-end rotor spinning machine as in claim 8, characterized in that the covering is applied to an elastic support surface.

11. Open-end rotor spinning machine as in claim 8, characterized in that the running surface of the covering is broken along its circumference by at least one recess.

12. Open-end rotor spinning machine as in claim 9, characterized in that the covering is broken up in the sense of the circumference and in that the parts are located at intervals next to each other on the driving pulley.

13. Open-end rotor spinning machine as in claim 1, characterized in that the driving means is made in the form of a tandem pulley with two non-rotatable individual pulleys mounted on a common axis and at a distance from each other.

14. Open-end rotor spinning machine as in claim 1, characterized in that the thickness of the covering of the supporting disks is 2 to 6 mm.

15. Open-end rotor spinning machine as in claim 14, characterized in that the ratio between width and thickness of the covering is from 5:1 to 2:1.

16. Open-end rotor spinning machine as in claim 14, characterized in that the covering is provided with at least one recess in the sense of the circumference, said recess having a depth sized so that the covering retains a remaining thickness of at least 1 mm.

17. Open-end rotor spinning machine as in claim 14, characterized in that the covering has a maximum thickness of 3 mm and is made without grooves.

18. Open-end rotor spinning machine comprising:

a rotatable rotor having a shaft;

at least two pairs of supporting disks, each disk being provided with a plastic covering around the circumferential surface thereof, said surfaces of each said pair of disks forming a nip therebetween which bearingly supports said rotor shaft, wherein at least one of the lateral surfaces of the covering of the supporting disks is provided with a recess in the direction of the circumference;

an axial bearing receiving the free end of said shaft;

means for driving said shaft;

wherein the paris of supporting disks are at an interior distance of 20 to 69 mm from each other, the center of gravity of the spinning rotor is at a distance of 15 to 28 mm in front of the pair of supporting disks disposed closer to said rotor, the shaft of the spinning rotor has a diameter of 5 to 9 mm and its free end extends 5 to 30 mm beyond the pair of supporting disks disposed farther from said rotor in the direction of the axial bearing.

19. Open-end rotor spinning machine as in claim 1, characterized in that the axial bearing of the free shaft end is located in a sleeve which is inserted into a bearing housing.

20. Open-end rotor spinning machine as in claim 19, characterized in that the free shaft end bears against a ball which is located in the sleeve and has little clearance.

21. Open-end rotor spinning machine as in claim 19, characterized in that two balls are provided in the sleeve, one behind the other in the sense of the axis.

22. Open-end rotor spinning machine as in claim 19, characterized in that the sleeve is made of a porous sintered material.

23. Open-end rotor spinning machine spinning machine as in claim 19, characterized in that the sleeve is provided with radial perforations outside the running surfaces of the balls.

24. Open-end rotor spinning machine as in claim 19, characterized in that the sleeve is surrounded by a felt dipping into an oil bath.

25. Open-end rotor spinning machine as in claim 1, characterized in that the shaft is provided with a wedge-shaped groove near its free end.

26. Open-end rotor spinning machine as in claim 19, characterized in that the passage opening in the bearing housing of the free shaft end is sealed by at least one sealing washer which is floatingly supported in front of the opening.

27. Open-end rotor spinning machine as in claim 1, characterized in that the shaft of the spinning rotor is driven directly by a tangential belt.

* * * * *

UNITED STATES PATENT AND TRADEMARK OFFICE

CERTIFICATE OF CORRECTION

PATENT NO. : 4,916,891

DATED : April 17, 1990

INVENTOR(S) : Landwehrkamp et al

It is certified that error appears in the above-identified patent and that said Letters Patent is hereby corrected as shown below:

Column 1, line 25: Change "000" to read --100,000--.

Column 1, line 67: Add --5-- after "pulley".

Column 1, line 68: Change "be" to read --bearing--.

Column 2, line 14: Insert --beyond-- between "mm" and "the".

Column 5, line 24: Change "9" to read --11--.

Column 6, line 9: Change "paris" to read --pairs--.

Column 6, lines 32-33: Delete the second occurrence of "spinning machine".

Signed and Sealed this

Twenty-first Day of May, 1991

*Attest:*

HARRY F. MANBECK, JR.

*Attesting Officer*

*Commissioner of Patents and Trademarks*